United States Patent [19]

Figge

[11] Patent Number: 4,664,174

[45] Date of Patent: May 12, 1987

[54] TWIN-BELT CONTINUOUS CASTER

[75] Inventor: Dieter Figge, Essen, Fed. Rep. of Germany

[73] Assignee: Fried. Krupp Gesellschaft mit beschränkter Haftung, Essen, Fed. Rep. of Germany

[21] Appl. No.: 878,271

[22] Filed: Jun. 25, 1986

[30] Foreign Application Priority Data

Jun. 27, 1985 [EP] European Pat. Off. ..... 85107970.7

[51] Int. Cl.[4] ..... B22D 11/06

[52] U.S. Cl. ..... 164/431; 164/481

[58] Field of Search ..... 164/431, 430, 432, 481

[56] References Cited

U.S. PATENT DOCUMENTS

| | | | |
|---|---|---|---|
| 2,904,860 | 9/1959 | Hazelett | 164/431 X |
| 4,276,921 | 7/1981 | Lemmens et al. | 164/431 X |
| 4,367,783 | 1/1983 | Wood et al. | 164/432 X |
| 4,510,990 | 4/1985 | Artz et al. | 164/431 |
| 4,545,423 | 10/1985 | Platek et al. | 164/481 |
| 4,552,201 | 11/1985 | Wood | 164/431 X |
| 4,601,324 | 7/1986 | Artz et al. | 164/432 |

FOREIGN PATENT DOCUMENTS

| | | |
|---|---|---|
| 1268319 | 5/1968 | Fed. Rep. of Germany . |
| 1433036 | 9/1971 | Fed. Rep. of Germany . |

*Primary Examiner*—Nicholas P. Godici
*Assistant Examiner*—J. Reed Batten, Jr.
*Attorney, Agent, or Firm*—Spencer & Frank

[57] ABSTRACT

A twin-belt continuous casting mold has a mold chamber which is formed of parallel length portions of cooled upper and lower casting belts as well as parallel length portions of endless side dams which bound the mold chamber laterally. In the zone of the mold chamber the side dams are backed by adjustable guide rails. The continuous caster further has upper and lower caster frames which respectively support the end drums for the upper and lower casting belts as well as a series of support rollers for backing up the casting belts. There are further provided seals which are in engagement with the casting belts and which serve for sealing off the mold chamber from the environment. Opposite longitudinal edges of each casting belt are approximately flush with the outer wall faces of the respective side dams and the casting belt support rollers are shorter than the distance between the outer wall faces of the two side dams. The seals are situated laterally adjacent the support rollers and are resiliently supported.

14 Claims, 14 Drawing Figures

TWIN-BELT CONTINUOUS CASTER

BACKGROUND OF THE INVENTION

This invention relates to a twin-belt continuous casting mold, particularly for casting steel. The mold chamber is formed of parallel length portions of cooled upper and lower casting belts as well as parallel length portions of endless side dams which bound the mold chamber laterally. In the zone of the mold chamber the side dams are backed by adjustable guide rails. The continuous caster has upper and lower caster frames which respectively support the end drums for the upper and lower casting belts as well as a series of support rollers for backing up the casting belts. There are further provided seals which are in engagement with the casting belts and which serve for sealing off the mold chamber from the environment.

In known twin-belt continuous casting molds of the above-outlined type, such as disclosed, for example, in German Pat. Nos. 1,268,319 and 1,433,036, the width of the casting belts is so designed that they project, together with the associated support rollers, significantly beyond the side dams. Unless, as an exception, ribbon-like castings with significant width are manufactured, the width of the casting belts is a multiple of the width of the mold chamber: in case of a casting width in the order of magnitude up to 200 mm, the casting belts have a width which is approximately three times that of the mold chamber.

The space adjacent the side dams is needed for accommodating the guide rails supporting the side dams as well as the adjusting devices therefor and further, for a secure sealing of the mold chamber to protect it against the large quantities of coolant.

The prior art constructions have the disadvantage that the casting belts will become hot only in the zone of the mold chamber—that is, along a central longitudinal belt area—whereas in the zone adjacent the side dams they have the lower temperature of the admitted coolant. The non-uniform temperature distribution over the width of the casting belts is particularly disadvantageous if materials having a very high melting point—such as steel—are being processed. Tests have shown that the casting belts in the zone of the mold chamber have a mean temperature of approximately 112° C. as compared to merely 20° C. at the outer zones.

The above-noted temperature differences cause a non-uniform heat expansion of the casting belts in the longitudinal and transverse direction and lead to deformations of the casting belts. Such deformations cannot be entirely compensated for even if large forces are applied, because the non-expanded, cold outer zones of the casting belts cannot be stretched beyond a predetermined extent, due to the involved additional stresses. Particularly the transitional zones between the hot central parts and the cold outer parts of the casting belts are endangered.

Apart from the fact that the service life of the casting belts is significantly reduced because of the unfavorable temperature distribution, a non-uniform expansion of the casting belts has the following disadvantages:

Between the casting belts and the side dams gaps appear which lead to sealing failures in the zone of the mold chamber. Further, in the zone of the gap tongue-like deposits (fins) appear which grow in the casting direction and lead to damages of the side dams at the mold chamber outlet. An expansion of the casting belts in the longitudinal direction is obstructed by the cold outer zones; this condition leads to the appearance of gaps between the casting and the casting belt since the latter is held only by point-like contacts on the support rollers. The air gaps adversely affect, by virtue of their heat insulating properties, the efficiency of the coolant of the twin-belt continuous casting mold so that the mold chamber has to be relatively long in order to obtain a self-supporting casting skin. It has been attempted to limit the size of the air gap by an outwardly convex design of at least those casting belt support rollers which are immediately upstream of the mold chamber outlet. Such rollers thus have a varying diameter which has its maximum situated in the middle of the roller length.

As a result of the non-uniform temperature distribution, the cold flanking zones of the casting belts are stressed taut while the hot, significantly expanded mid zones deform in an indeterminate direction. Thus, the casting belt may either bulge towards the casting whereby a satisfactory heat contact is obtained or it may bulge away from the casting, resulting in an air gap, causing a poor heat contact. Apart from the fact that the direction of bulging of the casting belt cannot be foreseen, the deformation during the casting process cannot be influenced, because at any moment the bulged deformation of the casting belt may snap into an oppositely oriented configuration. Thus, zones of good heat contact between casting and casting belt are suddenly transformed into zones of poor heat contact. The inferior cooling effect of the twin-belt continuous casting mold involved with such phenomena may cause, in the worst case, a complete rupture of the casting, leading to an interruption of the casting operation.

SUMMARY OF THE INVENTION

It is an object of the invention to provide an improved twin-belt continuous casting mold of the above-outlined type in which, even in case materials of a high melting point (such as steel) are cast, the temperature distribution is equalized particularly over the entire width of the casting belts and thus the possibility is provided that the casting belts may be stressed sufficiently taut even in the central zones.

This object and others to become apparent as the specification progresses, are accomplished by the invention, according to which, briefly stated, the opposite longitudinal edges of each casting belt are approximately flush with the outer wall faces of the respective side dams; further, the casting belt support rollers are shorter than the distance between the outer wall faces of the two side dams and the seals are situated laterally adjacent the support rollers and are resiliently supported.

Thus, according to an important aspect of the invention, the width of the casting belts is so designed that they project only slightly, if at all, beyond the outer faces of the lateral dams. Accordingly, the support rollers which back up the casting belts are of short construction to provide sufficient space for seals which lie against the casting belts above or, respectively, underneath the side dams and which prevent molten metal from escaping from, and circulating coolant from entering into the mold chamber. The seals should be designed such that they remain effective even at temperatures in excess of 200° C. at the mold chamber outlet. A sealing of the mold chamber is of particular importance in the inlet zone behind the mold chamber inlet, despite the use of narrow casting belts, because the casting which is formed in that zone has only a very thin skin.

The use of narrow casting belts whose width at least approximately corresponds to the distance between the outer faces of the opposite side dams has the result that in the zone of the mold chamber entrance the mean temperature of the longitudinal central casting belt portions aligned with the mold chamber is approximately the same as that of the longitudinal lateral casting belt portions aligned with the side dams. Different expansions of the casting belts transversely to their length dimension which involve the earlier-described disadvantages thus cannot appear in the particularly endangered zone behind the mold chamber entrance.

According to a further feature of the invention, the seals, at least in the contact zone with the associated casting belt, are made of an appropriate fiber material. If metals of high melting point are being processed by the continuous caster, seals having a ceramic fiber material at least in the zone of contact with the casting belts are particularly advantageous.

According to a further feature of the invention, due to the lack of space because of the narrow casting belts, the support rollers are not held laterally: they are supported at locations in alignment with the mold chamber.

According to a further feature of the invention, the support rollers and seals are supported jointly on the carriers of the respective upper or lower caster frame.

The seals have preferably a cooled carrier arm and a rocker which is supported on the carrier arm and on the associated casting belt with the interposition of a spring element. The seals are at least in part made of a material or are coated such that they are capable of resisting high environmental temperatures.

For supporting the casting belts even in the zone of the side dams, the support rollers are, according to a further feature of the invention, longer than the width of the mold chamber. In such an arrangement the side dams should be of relatively wide construction to take the sealing of the mold chamber into consideration.

In accordance with a further feature of the invention, the working width with which the seals contact the respective casting belt is substantially the same as the width of the side dams. Accordingly, the support rollers are in engagement with the respective upper or lower casting belt only in alignment with the mold chamber. It is an advantage of such an arrangement that even in case of a relatively narrow construction of the side dams, a penetration of the molten metal between the cooperating mold chamber walls cannot occur.

In accordance with a further feature of the invention, the support rollers are shorter than the width of the mold chamber and preferably the width with which the seals engage the casting belts corresponds to that of the side dams. The advantage of such arrangement resides in the fact that the sealing and guiding elements (that is, the seals and guide rails for the side dams situated in the zone of the side dams) are separated from the support rollers situated in the zone of the mold chamber.

The invention also serves the purpose of rendering the temperature distribution uniform in the length dimension of the casting belts. The increasing temperatures of the side dams in the casting direction and the casting belt portions cooperating with the side dams may be limited according to the invention in that the side dams—departing from prior art constructions—are cooled at least in the outlet zone but preferably also in the mid zone of the length of the mold chamber. In case the side dams are equipped in both zones with an additional cooling system, preferably an air cooling arrangement is used in the mid zone of the mold chamber and a water cooling arrangement is used in the outlet zone thereof. The additional cooling may be effected by providing, in the appropriate zones of the mold chamber, coolant channels whose outlet openings are aligned with the respective outer wall face of the side dams. According to a further feature of the invention, the coolant channels and their outlet openings form components of the guide rails for the side dams.

For protecting the outer faces of the side dams against coolant water introduced in the zone of the casting belts, the upper and lower frames of the twin-belt continuous casting mold are sealed from one another at the height of the mold chamber and thus bound a cooling chamber containing the seals. According to a further feature of the invention, such a sealing may be effected by sealing strips interconnecting the frame portions.

In accordance with still another feature of the invention, the side dams are preheated to have, at the mold chamber inlet, a temperature which approximately corresponds to that of the mean casting belt temperature prevailing at that location.

DESCRIPTION OF THE PREFERRED EMBODIMENTS

Figure 1A:
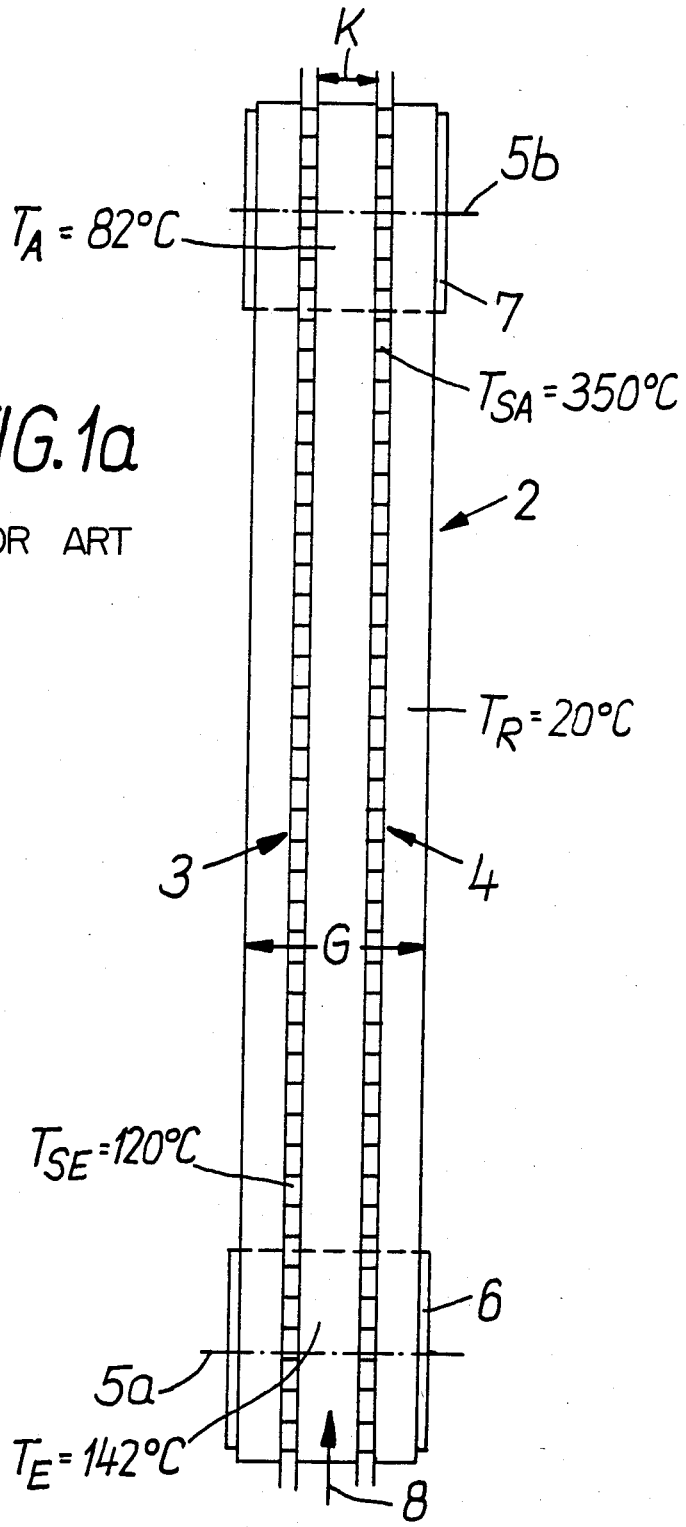
FIG. 1a PRIOR ART
FIG. 1*a* is a schematic plan view of a lower casting belt of a twin-belt continuous caster according to the prior art, illustrating temperature distributions.
Figure 1B:
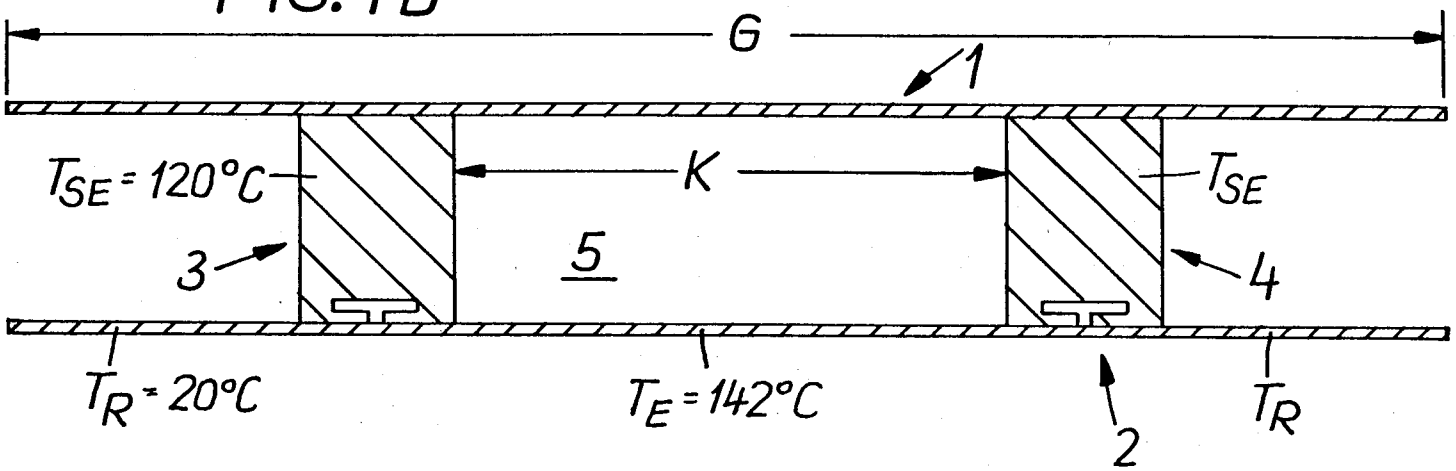
FIG. 1b PRIOR ART
FIG. 1*b* is a sectional front elevational view of a mold chamber of a twin-belt continuous caster according to the prior art.

Turning to FIGS. 1*a* and 1*b*, there is shown a prior art construction of a twin-belt continuous casting mold having upper and lower casting belts 1 and 2, respectively, between which there are arranged endless travelling side dams 3 and 4. The oppositely located upper and lower casting belts 1 and 2 as well as the oppositely located lateral side dams 3 and 4 constitute mold walls which define a cross-sectionally rectangular mold chamber 5. The casting belts 1 and 2 have a width G which is a multiple of the width K of the mold chamber 5. Thus, for example, in case of a mold chamber width of 180 mm the casting belt width is 535 mm. Each casting belt 1 and 2 is looped around an end drum 6 at the mold chamber entrance 5*a* and an end drum 7 at the mold chamber exit 5*b* and is driven codirectionally whereby a travelling mold chamber having a casting direction 8 is obtained. The length of the mold chamber 5 is predetermined by the distance between the mold chamber entrance 5*a* and the mold chamber outlet 5*b*.

In case of casting steel in the twin-belt continuous casting mold of the above-outlined conventional type (which includes a water cooling system and casting belts made of steel) at the mold chamber entrance 5*a* the following temperatures prevail, as illustrated in FIG. 1*a*:

Mean casting belt temperature $T_E$ in the central belt zone aligned with the mold chamber 5=142° C. (inside: 165° C., outside 120° C.);

Casting belt temperature $T_R$ at the outer zones externally of the side dams 3 and 4=20° C.;

Side dam temperature $T_{SE}$=120° C.

At the mold chamber outlet 5*b* the following temperatures prevail:

Mean casting belt temperature $T_A$ in the central belt zone aligned with the mold chamber 5=82° C. (inside temperature: 93° C., outside temperature: 71° C.);

Casting belt temperature at the outer zones externally of the side dams 3,4 is again $T_R$=20° C., due to water cooling.

The temperature of the non-cooled side dams has, in the course of their motion in the casting direction, increased to $T_{SA}$=350° C.

In view of the above, the mean casting belt temperature which prevails along the length of the mold chamber is in the central belt zone 112° C. as compared to 20° C. at the flanking zones. The non-uniform expansion of the casting belts resulting from such temperature distribution leads to casting belt deformations, causing gaps to appear between the casting belts 1, 2 and the side dams 3, 4 and results in a partial loss of the heat contact between the casting and the casting belts. Such a non-uniform expansion cannot be compensated even with the application of large tensioning forces.

The above-discussed temperature conditions have a particularly disadvantageous effect during the casting of metals having a high melting point, such as steel. Even in the casting of metals such as copper or copper alloys, the service life of the casting belts is shortened to a significant degree and the cooling effect of the cooling system of the twin-belt continuous casting mold is adversely affected to an appreciable extent.

Figure 2B:
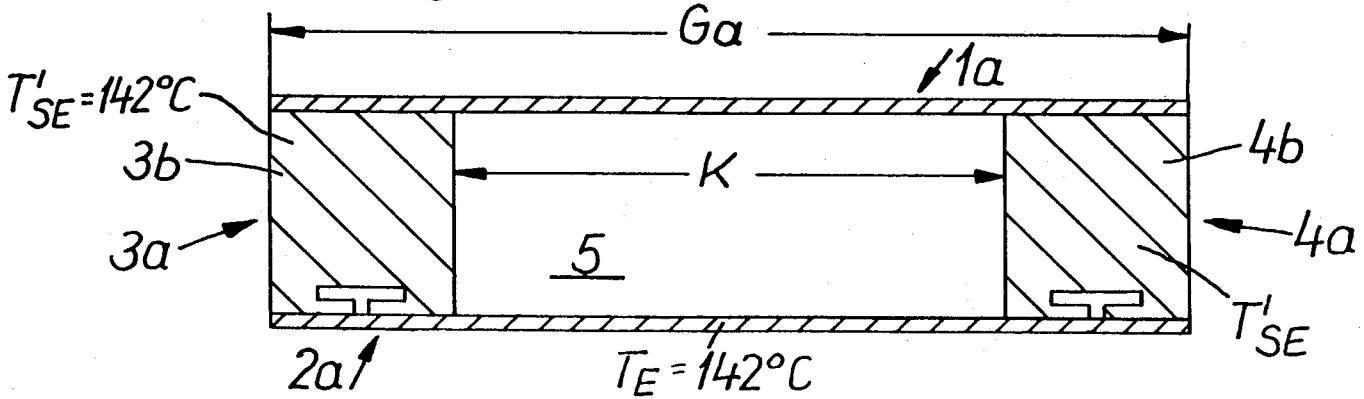
FIG. 2*b* is a sectional front elevational view of a mold chamber of a twin-belt continuous caster according to a preferred embodiment of the invention.
Figure 2A:
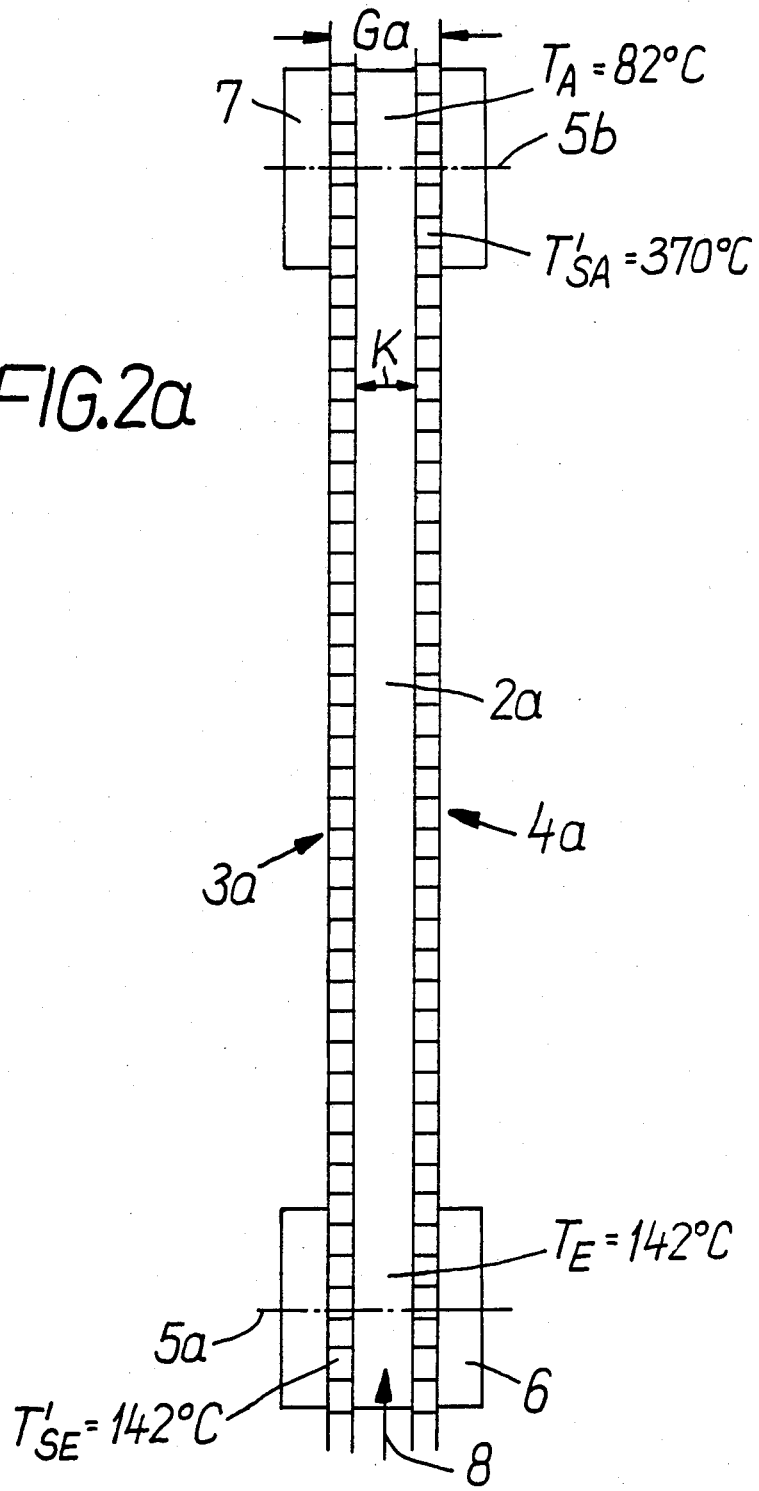
FIG. 2*a* is a schematic plan view of a lower casting belt of a twin-belt continuous caster according to a preferred embodiment of the invention.

Turning now to FIGS. 2*a* and 2*b*, according to the invention, narrower casting belts 1*a* and 2*a* are used whose opposite outer longitudinal edges are at least approximately flush with the outer faces 3*b* and 4*b* of the respective side dams 3*a* and 4*a*. Such dimensions favorably affect the above-described temperature conditions and, as a result, improve the operational safety of the twin-belt continuous casting mold, particularly during the casting of metals having a high melting point. Thus, for example, the casting belt width Ga is 330 mm while the mold chamber width K is, as before 180 mm. The width of the side dams 3*a* and 4*a* is preferably greater than that of the side dams 3 and 4 shown in the prior art construction illustrated in FIGS. 1*a* and 1*b*.

The narrower casting belts have no effect on the mean casting belt temperatures at the mold entrance and at the mold outlet: the values $T_E$ and $T_A$ remain 142° C. and 82° C., respectively. According to the invention, the side dams are preheated to a greater degree than conventionally so that at the mold chamber entrance 5*a* they enter the zone of the mold chamber with a temperature of $T40_{SE}$=142° C., while at the mold chamber exit 5*b* the approximate temperature $T'_{SA}$=370° C. This temperature distribution has the result that at the mold chamber entrance the casting belts have, in the contact zone with the side dams, approximately the same temperature as in the zone of the mold chamber. Thus, at the mold chamber entrance the casting belts will not undergo different heat expansions in the transverse direction, whereby the discussed disadvantages are suppressed. The heat expansion distributed uniformly along the width of the casting belts may be equalized by longitudinally acting tension forces because the previously described outer, flanking zones having the low temperature $T_R$ no longer exist. The use of narrower casting belts 1*a* and 2*a* thus effects a more secure sealing of the mold chamber from the environment by providing, at the mold chamber inlet, an equalization of the temperature distribution in the transverse direction of the casting belt, equalizing the temperature-caused expansions.

Figure 3:
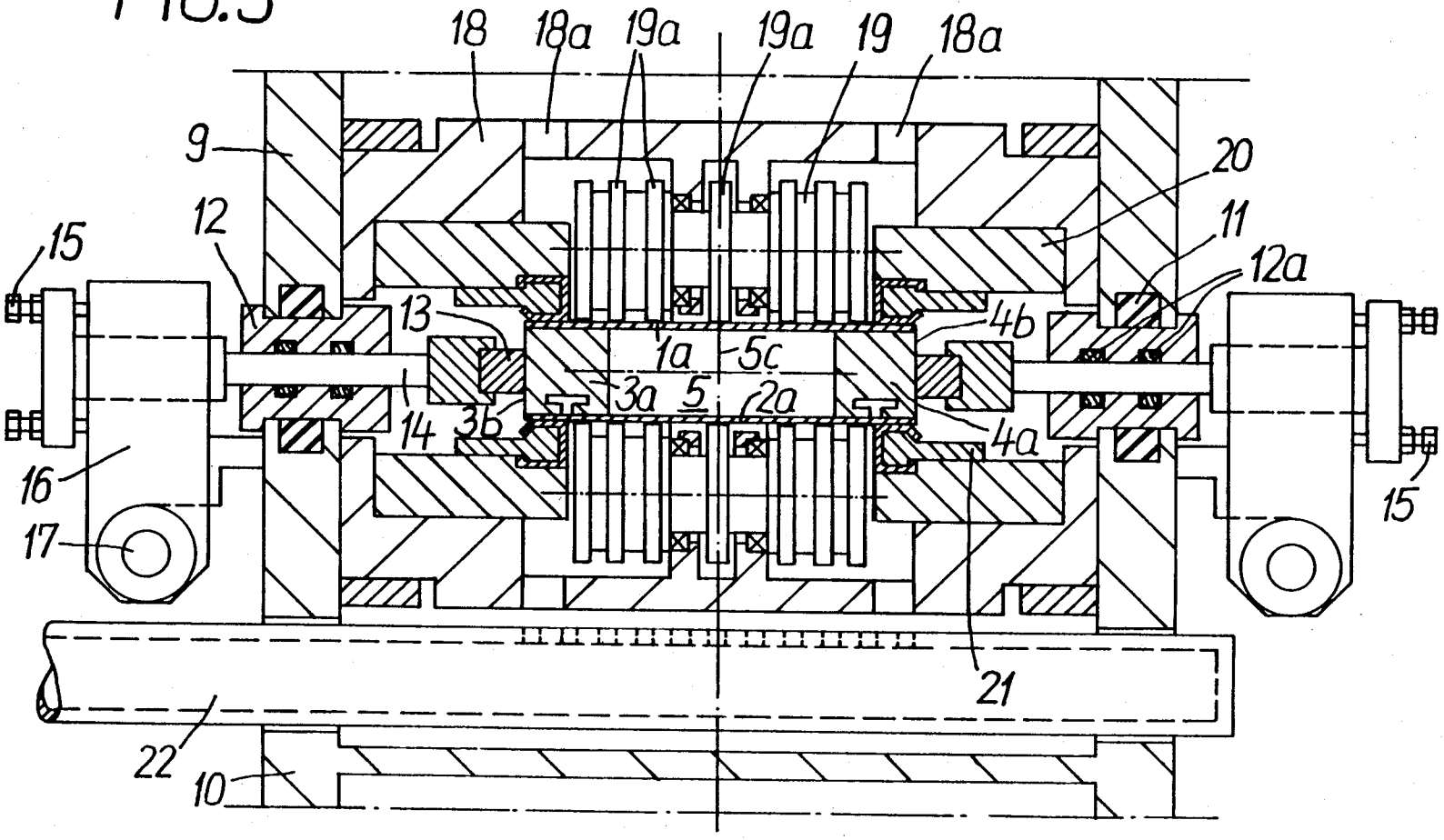
FIG. 3 is a schematic sectional front elevational view of the constructions shown in FIGS. 2*a* and 2*b*, illustrating further details of the twin-belt continuous casting mold according to the invention.

Turning now to FIG. 3, the upper frame 9 and the lower frame 10 of the twin-belt continuous mold engage one another by means of sealing bars 12 extending in the length dimension of the mold chamber 5 and being equipped with sealing elements 11. This sealing arrangement hermetically separates the environment from the space in which the outer wall faces 3*b*, 4*b* of the side dams 3*a* and 4*a* are located.

The position of the side dams 3*a* and 4*a* is determined by the guide rails 13 which engage the respective outer faces 3*b* and 4*b* of the side dams 3*a* and 4*a* and which have setting rods 14 slidably passing through the sealing bars 12. The setting rods 14 are externally supported on a console 16 by setscrews 15. The console 16 is secured to the lower frame 10 by a pivot pin 17 for a swinging motion in a plane perpendicular to the casting direction. By turning the setscrews 15 the position of the associated guide rail 13 may be steplessly varied. The seal between the setting rod 14 and the sealing bar 12 is effected by means of a plurality of sealing rings 12*a* carried in the sealing bar 12.

The upper and lower caster frames 9 and 10 are, above and, respectively, underneath the sealing bars 12 equipped with transverse carriers 18 which hold support rollers 19 arranged in a series in the longitudinal direction of the mold chamber 5 and seals 21 with the interposition of carrier plates 20. The support rollers 19 engage the upper and, respectively, lower casting belt 1*a* and 2*a* in the zone of the mold chamber 5 and in the zone of the side dams 3*a*, 4*a* by circumferential guide ribs 19*a*. The axial length of the support rollers corresponds to the casting belt width Ga shown in FIG. 2*b* and is thus shorter than the distance between the outer faces 3*b* and 4*b* of the two side dams 3*a* and 4*a*.

Figure 6A:
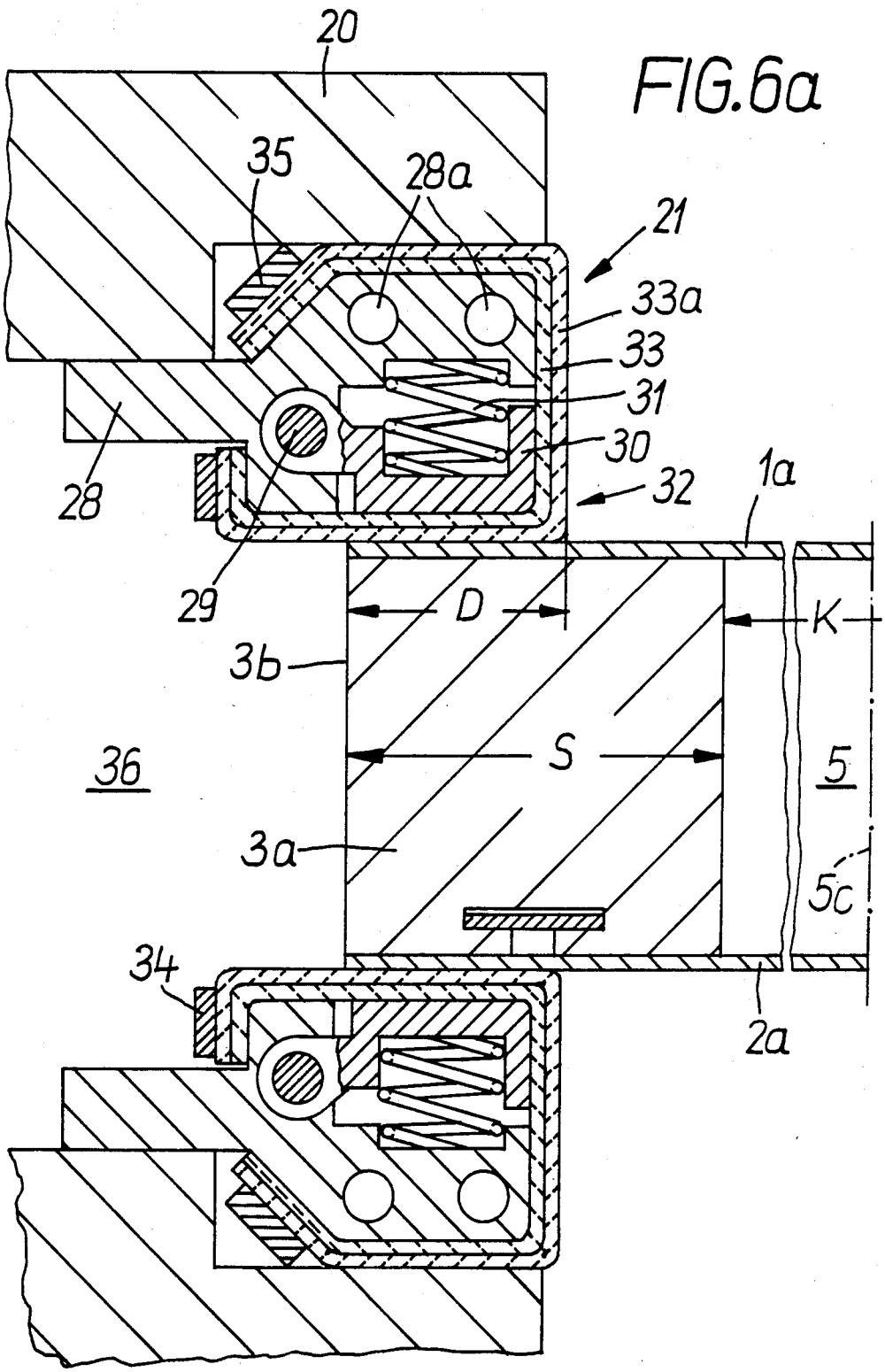
FIG. 6*a* is a sectional front elevational view illustrating details of a further embodiment of the invention.

The sealing between the casting belts and the side dams is effected by the seals 21 which are situated adjacent the support rollers 19 and engage resiliently the outer zones of the casting belts 1*a* and 2*a*. The width D with which the seals 21 engage the casting belts 1*a*, 2*a* is thus smaller than the width S of the side dams (FIG. 6*a*).

The seals 21 ensure that the coolant introduced in the zone of the casting belts 1*a*, 2*a* through bores 18*a* provided in the transverse carrier 18 is prevented from entering the mold chamber 5. The introduction of cooling water is effected by supply pipes 22 which are arranged above or, respectively, underneath the transverse carrier 18. In FIG. 3, only the supply pipe 22 associated with the lower frame 10 is shown.

Figure 4:
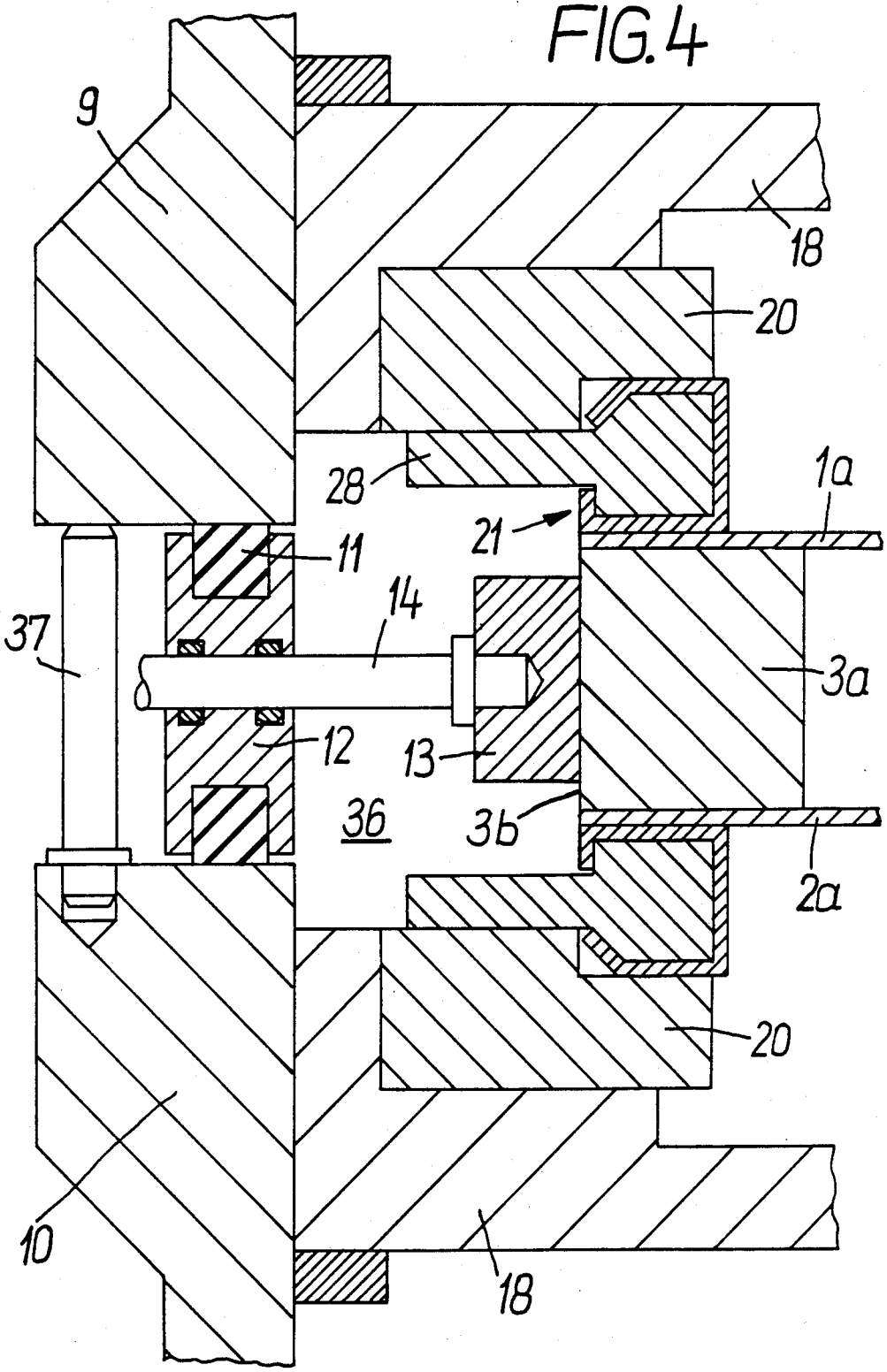
FIG. 4 is a sectional front elevational view of one part of the construction of FIG. 3, shown on an enlarged scale.

The embodiment according to FIG. 4 differs from the embodiment of FIG. 3 in that the sealing bar 12 serves only for sealing the space 36 from cooling water. The outer face 3*b* of the side dam 3*a* bounds the closed space 36. The positioning of the upper frame 9 relative to the lower frame 10 is effected by spacer posts 37 which are situated externally of the chamber 36 adjacent the sealing bar 12.

Figure 5:
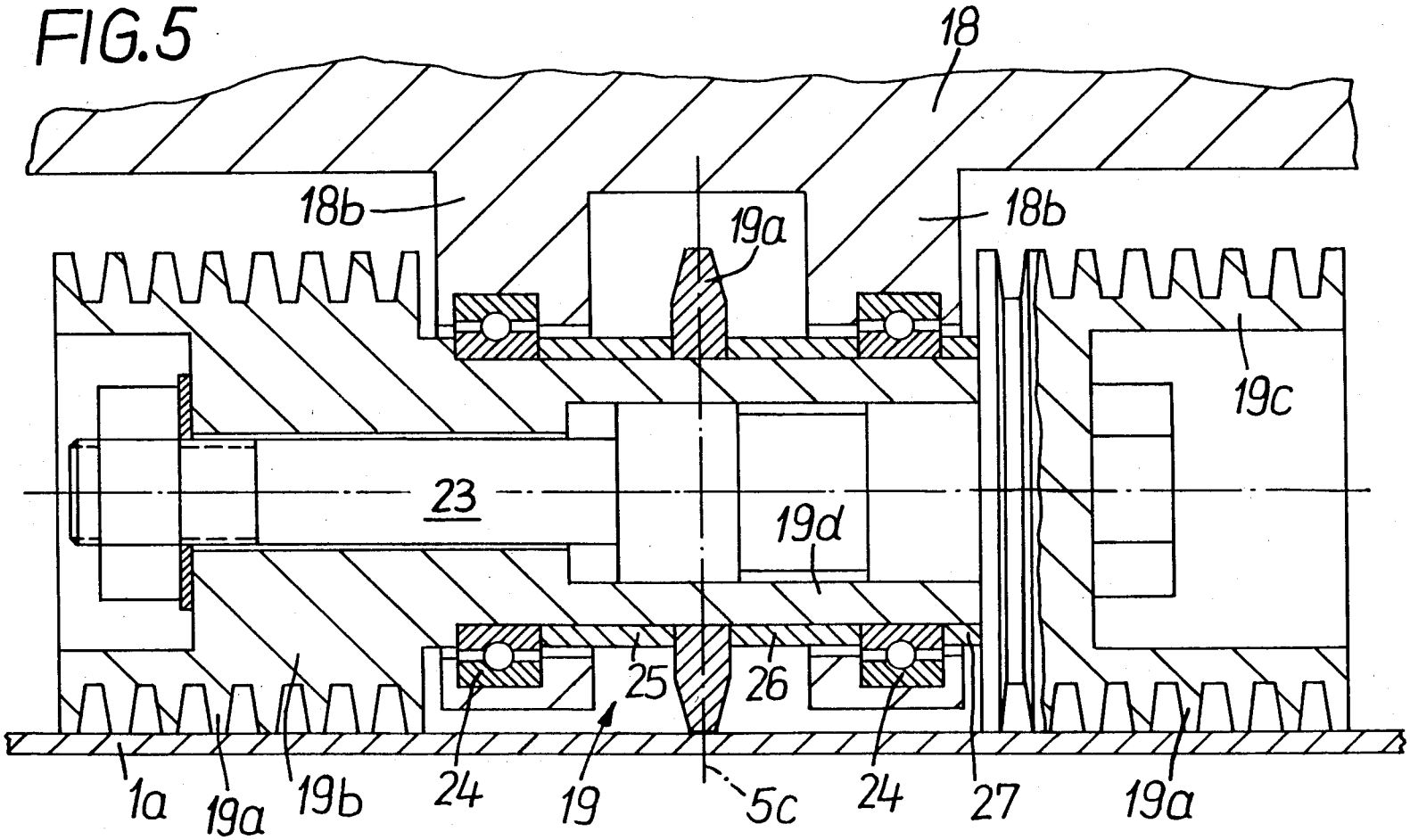
FIG. 5 is a sectional front elevational view of another part of the construction of FIG. 3, shown on an enlarged scale.

Referring to FIG. 5, each support roller 19 is composed of two cylindrical bodies 19*b* and 19*c* secured to one another in axial alignment by means of a central tensioning bolt 23. The tapered central roller part 19*d* which constitutes an axial extension of the cylindrical body 19*b* carries a circumferential support rib 19*a* which is in engagement with the upper casting belt 1*a* in the zone of the vertical halving plane 5*c* of the mold chamber 5.

The rotary support of the support rollers 19 is formed of roller bearings 24 which are inserted on the central roller part 19*d* and are in engagement with two webs 18*b* of the transverse carrier 18. The sealing of the roller bearings 24 against the surrounding cooling water is not shown for the sake of clarity. The positioning of the components 24 and 19*a* relative to the central roller portion 19*d* of the support roller 19 is effected by spacer sleeves 25, 26 and 27 mounted side by side on the tapered portion 19*d*. As shown in FIG. 3, the webs 18 and the roller bearings 24 are arranged such that in the zone of the extension of the mold chamber 5 they lie above or below the respective upper or lower casting belt 1*a* or 2*a*. The cylinder bodies 19*b* and 19*c* are provided each with a plurality of axially spaced, circumferential support ribs 19*a*.

Referring to FIG. 6*a*, the seals 21 are equipped with a carrier arm 28 secured (for example, by a screw connection) to the carrier plate 20. In the carrier arm 28 there is mounted a pin 29 which pivotally supports a metal rocker 30 which engages, externally of the pin 29, the carrier arm 28 and is biased thereagainst by a spring 31. The carrier arm 28 has coolant bores 28*a* which form part of a cooling water circuit. Since the lower seals 21 which are in engagement with the lower casting belt 2*a* are exposed to additional stresses, the associated springs 31 have to be designed or biased differently from the springs 31 associated with the upper seals 21. The latter need to take up only the pressure forces generated in the mold chamber 5.

Since the casting belt seal has to be effected in the zone of the twin-belt continuous casting mold where temperatures may be in excess of 200° C., the carrier arm 28 and the metal rocker 29 are provided with a heat protecting jacket 32 which is composed of two heat-resistant layers 33 and 33*a* of a lubricated ceramic fiber material which preferably has the following composition: 55% $SiO_2$, 20% CaO, 10% $Al_2O_3$ and the remainder MgO. The outer heat protective layer 33*a* engages, under the pressing effect of the resiliently supported metal rocker 30, the associated side dam with the intermediary of the casting belt 1*a* or, respectively, 2*a*, and thus, while ensuring a sufficient mobility of the casting belts and side dams, prevents an escape of the molten metal from the mold chamber 5 or a penetration of cooling water thereinto. The terminal portions of the heat protective layers 33, 33*a* are connected with the carrier arm 28 by means of clamping elements 34, 35.

Since the width D with which the seals 21 engage the respective side dams (with the interposition of the respective casting belt) is less than the width S of the side dams, the associated support rollers (constructed in accordance with the embodiment according to FIG. 3) may be so dimensioned that they back up the casting belts 1*a*, 2*a* also in the zone above and, respectively, below the side dams. The casting belt surface affected by the cooling water is accordingly relatively large. Ensuring a sufficient engagement width D preconditions that the width S of the side dams be accordingly large.

Figure 6B:
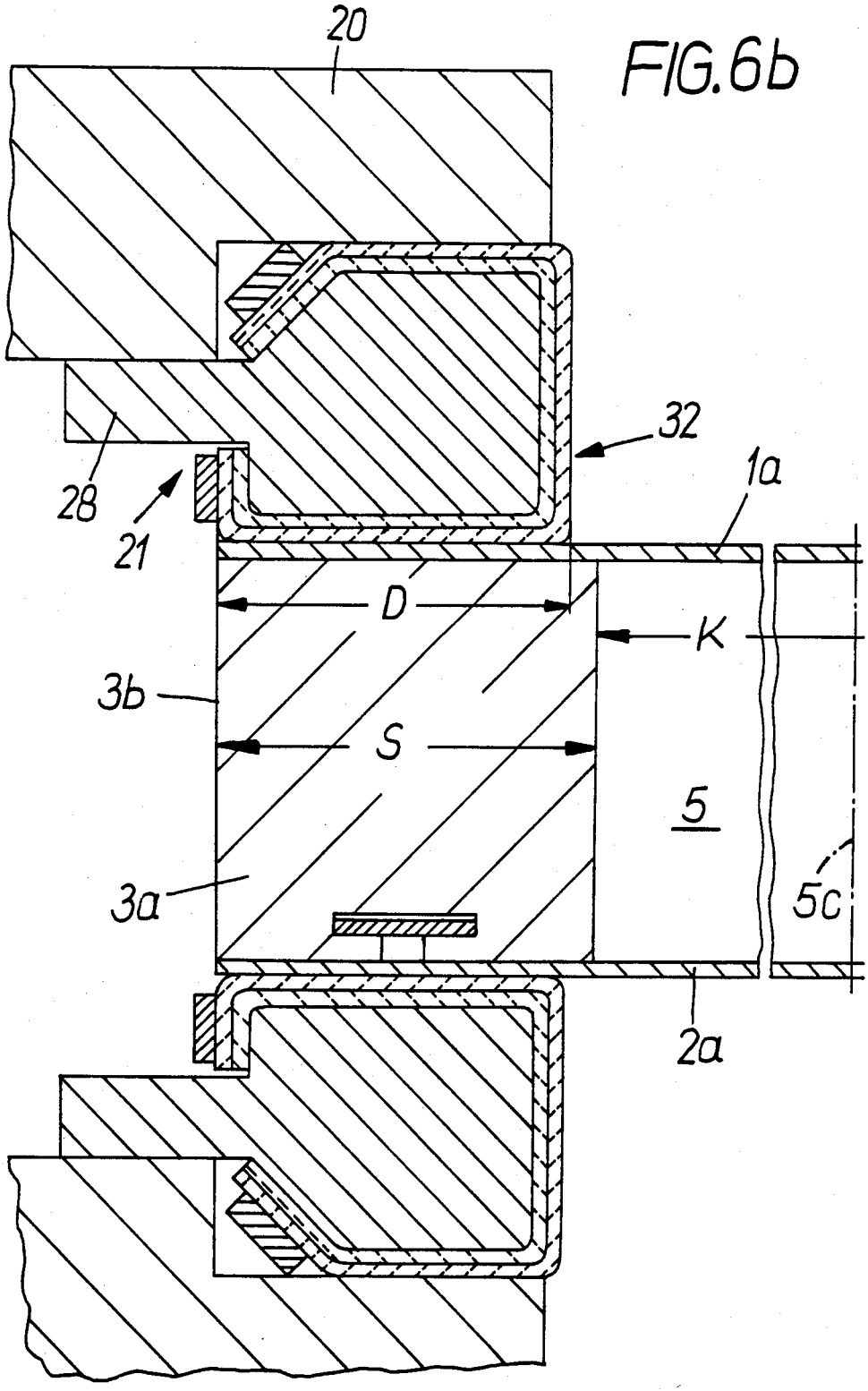
FIG. 6*b* is a sectional front elevational view illustrating details of another preferred embodiment of the invention.

Turning now to the embodiment illustrated in FIG. 6*b*, the seals 21 are dimensioned and arranged such that their width D with which they contact the casting belts 1*a* and 2*a*, approximately corresponds to the width S of the side dams. The non-illustrated support rollers situated between each adjoining seal 21 have, accordingly, a length which is less than the width K of the mold chamber. The advantage of this arrangement resides in the fact that it makes possible a better sealing of the mold chamber 5 even if side dams having a relatively small width S are used. Since the seals 21 back up the casting belts 1*a*, 2*a* directly adjacent the mold chamber 5 (contrary to the support rollers) in a face-to-face arrangement, a formation of gaps between the casting belts and the side dams in the zone of the mold chamber 5 cannot occur. For this reason, the embodiment according to FIG. 6*b* is better adapted for use in casting molten steel under pressure than the embodiment according to FIG. 6*a*.

The temperature of the side dams 3*a* and 4*a* which increases as the side dam moves in the casting direction, may be limited by providing an additional cooling thereof adjacent the entrance zone of the mold chamber 5, along approximately 20 to 25% of the total length of the mold chamber, as will be discussed in connection with FIGS. 7 and 8.

Figure 7:
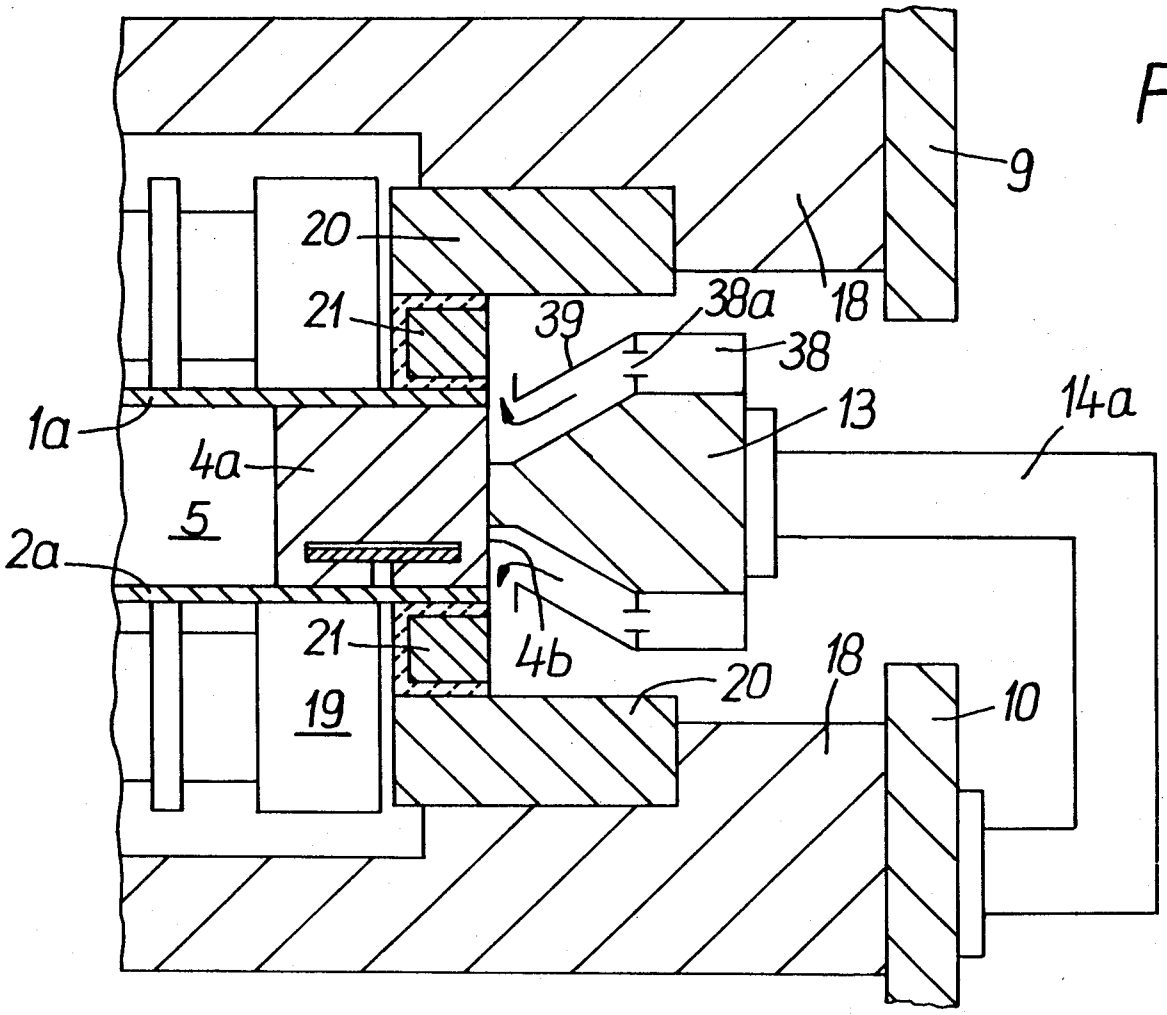
FIG. 7 is a sectional front elevational view illustrating details of a further preferred embodiment of the invention.

Turning now to the embodiment illustrated in FIG. 7, the illustrated side dam guiding rail 13—which is supported by a bell crank lever 14*a* on the lower frame 10—is equipped with two air guide channels 38 whose outlet openings 38*a* are in alignment with the side dam 4*a* and are at a distance therefrom. The cooling air emitted by the outlet openings 38*a* arrives under the effect of angled guide plates 39 secured to the air guide channels 38, in the zone of the outer face 4*b* of the side dam 4*a* and is thereafter guided into the zone of the seals 21 contacting the casting belts 1*a* and 2*a*.

The twin-belt continuous casting mold is, for equalizing the temperature distribution in the casting belts, advantageously so designed that the air guide channels 38 and the guide plates 39 reach without interruption as far as the exit zone of the mold chamber 5 and thus cool the side dams and seals in the longitudinal mid zone and exit zone of the mold chamber 5.

Figure 8:
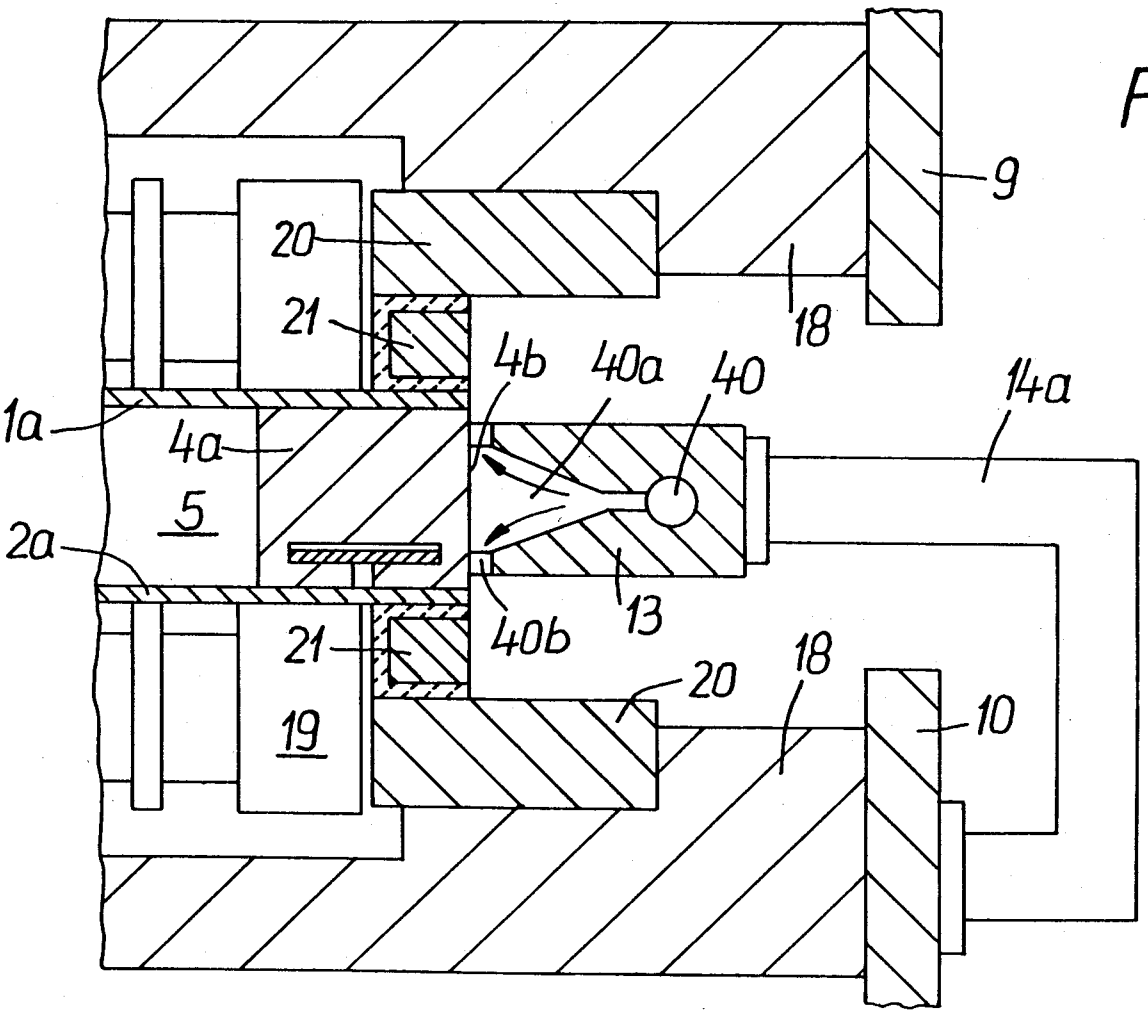
FIG. 8 is a sectional front elevational view illustrating details of still another preferred embodiment of the invention.

In accordance with another advantageous embodiment illustrated in FIG. 8, the guide rails 13 for the side dams are designed as cooling units through which water is supplied to the outer faces of the side dams and the seals 21. The guide rails 13 each contain a longitudinally extending cooling water passage 40 which, on the side oriented towards the side dam continues as a supply funnel 40*a* and thereafter is converted into outlet passages 40*b* arranged tangentially to the side dam. In such an arrangement of the outlet passages 40*b* it is of importance that the cooling water reaches the outer face of the respective side dam as well as the adjacent seal 21.

Figure 9:
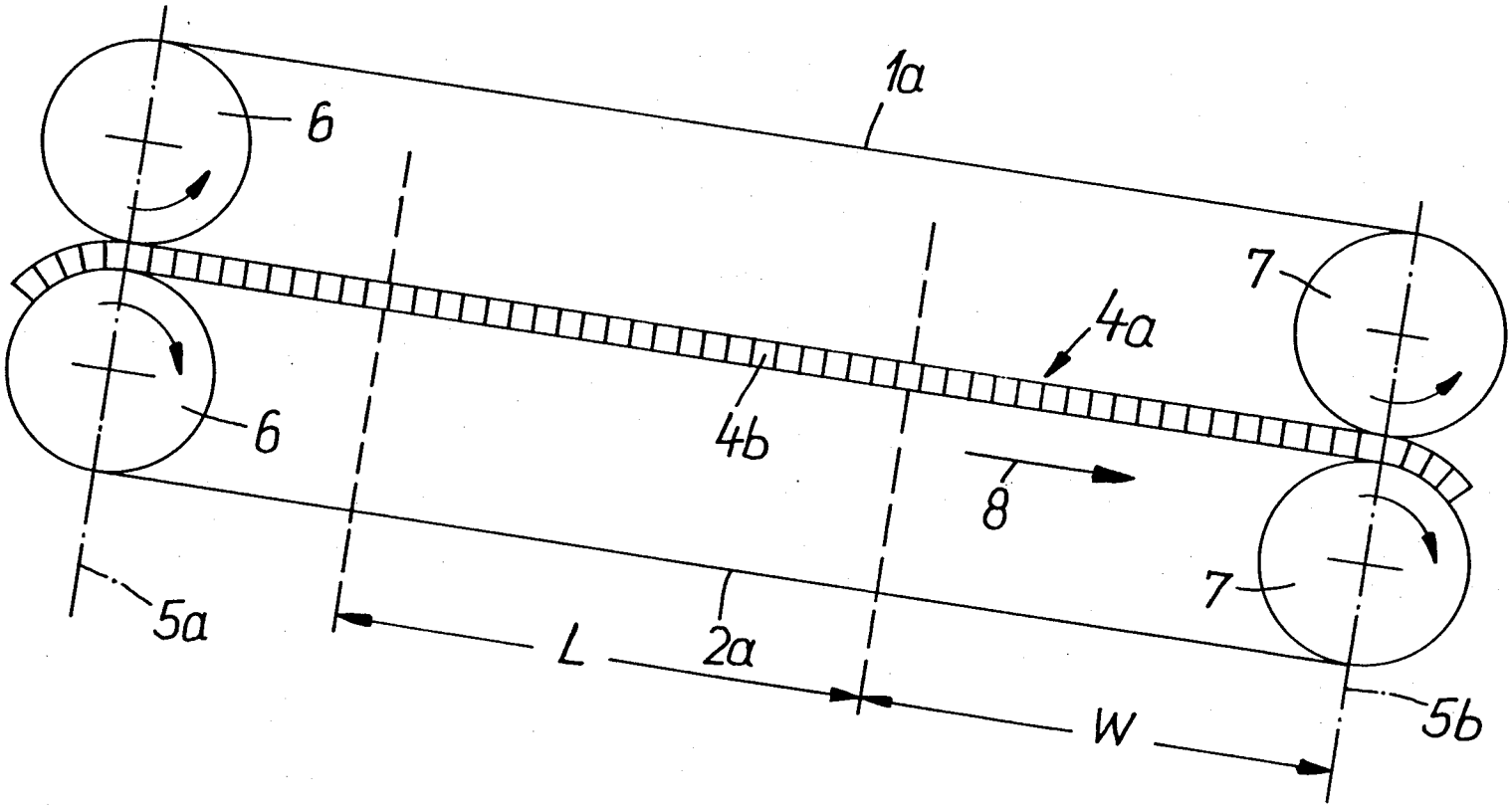
FIG. 9 is a diagrammatic side elevational view of a twin-belt continuous casting mold, symbolically illustrating a further preferred embodiment of the invention.

The simultaneous use of an additional air cooling system according to FIG. 7 and an additional water cooling system according to FIG. 8 for the side dams and seals leads to the arrangement shown schematically in FIG. 9. In this construction, the twin-belt continuous casting mold is, in the middle zone of the mold length, provided with an air cooling system L and is, in the exit zone, provided with a water cooling system W. By virtue of the additional cooling systems, temperature conditions may be affected in the zone of the mold walls in such a manner that the casting belts and side dams have approximately the same temperature at the mold exit 5*b*. The cooling systems L and W each extend preferably over approximately 40% of the length of the mold chamber. The length of the entrance zone which is situated upstream of the cooling system L and which thus lacks additional cooling of the side dams thus corresponds approximately to 20% of the mold chamber length.

Figure 10:
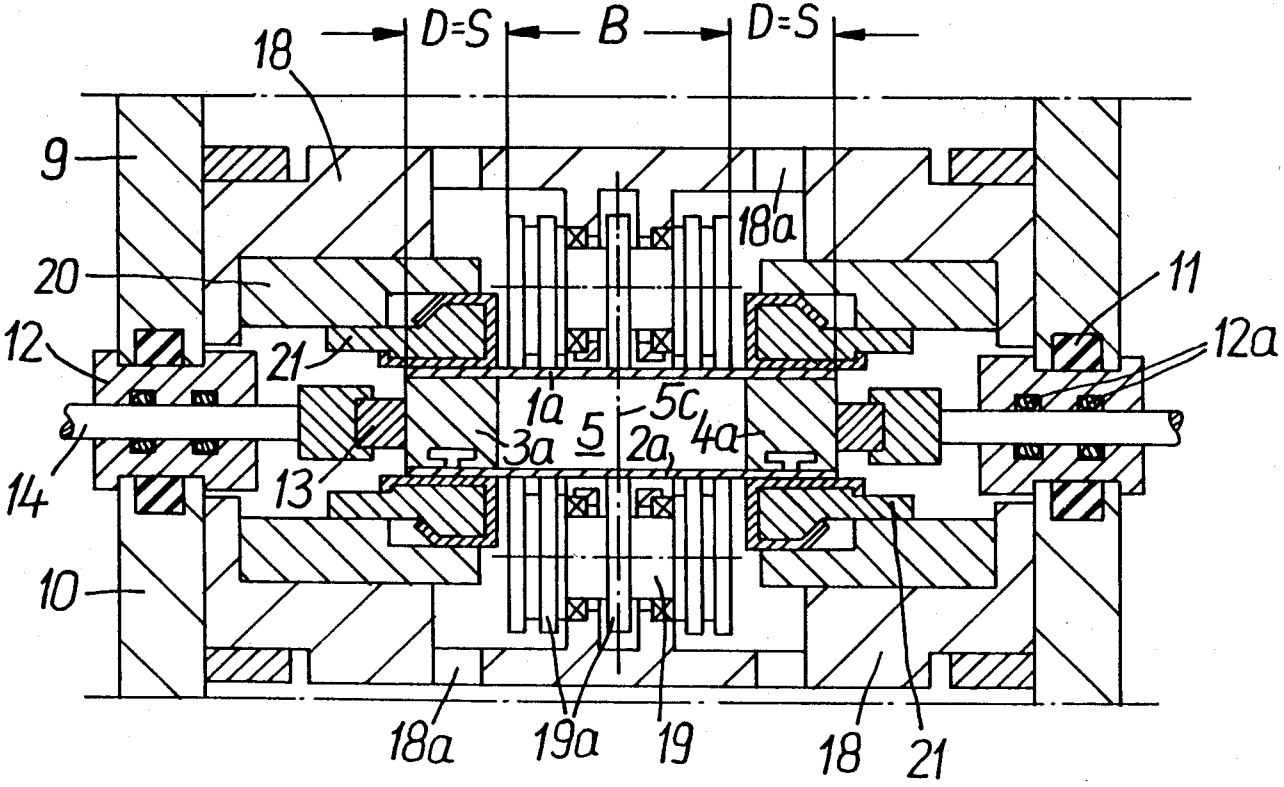
FIG. 10 is a sectional front elevational view similar to FIG. 3, illustrating a further preferred embodiment of the invention.

Turning to the embodiment illustrated in FIG. 10, the guide rails 13 and the seals 21 situated in the zone of the side dams 3*a*, 4*a* are separated from the support rollers 19 situated in the zone above and underneath the mold chamber 5. Such a separation is effected by providing that the width D with which the seals 21 engage the casting belts 1*a*, 2*a* equals the width S of the side dams. The length B of the support rollers 19 is accordingly less than the width of the mold chamber, so that the support rollers 19 back up the casting belts 1*a* and 2*a* exclusively externally of that zone in which the casting belts are backed up by the side dams.

Due to the short length of the support rollers 19 (which is less than the distance between the side dams) the associated roller bearings 24 (FIG. 5) are situated in the vicinity of the vertical halving plane 5*c* of the mold chamber 5.

The arrangement of the support rollers 19 exclusively externally of the zone of the side dams makes it possible to back up the upper and, respectively, lower casting belt 1*a* and 2*a* independently from the geometrical conditions predetermined by the side dams and thus undesired casting belt deformations may be counteracted.

The advantages which are achieved by the invention reside in that based on the use of narrower casting belts—whose width corresponds generally to the distance between the outer wall faces of the opposite side dams—no cold outer portions in the casting belts can appear which would prevent an expansion of the casting belts in the transverse and longitudinal directions. The equalization of the temperature distribution in the longitudinal and transverse directions of the casting belts results in lesser stresses and thus a longer service life as well as a better cooling effect of the twin-belt continuous casting mold. An adverse effect on the quality of the casting and/or the operational safety of the twin-belt continuous casting mold as a result of undesired casting belt deformations thus cannot occur.

Figure 11:
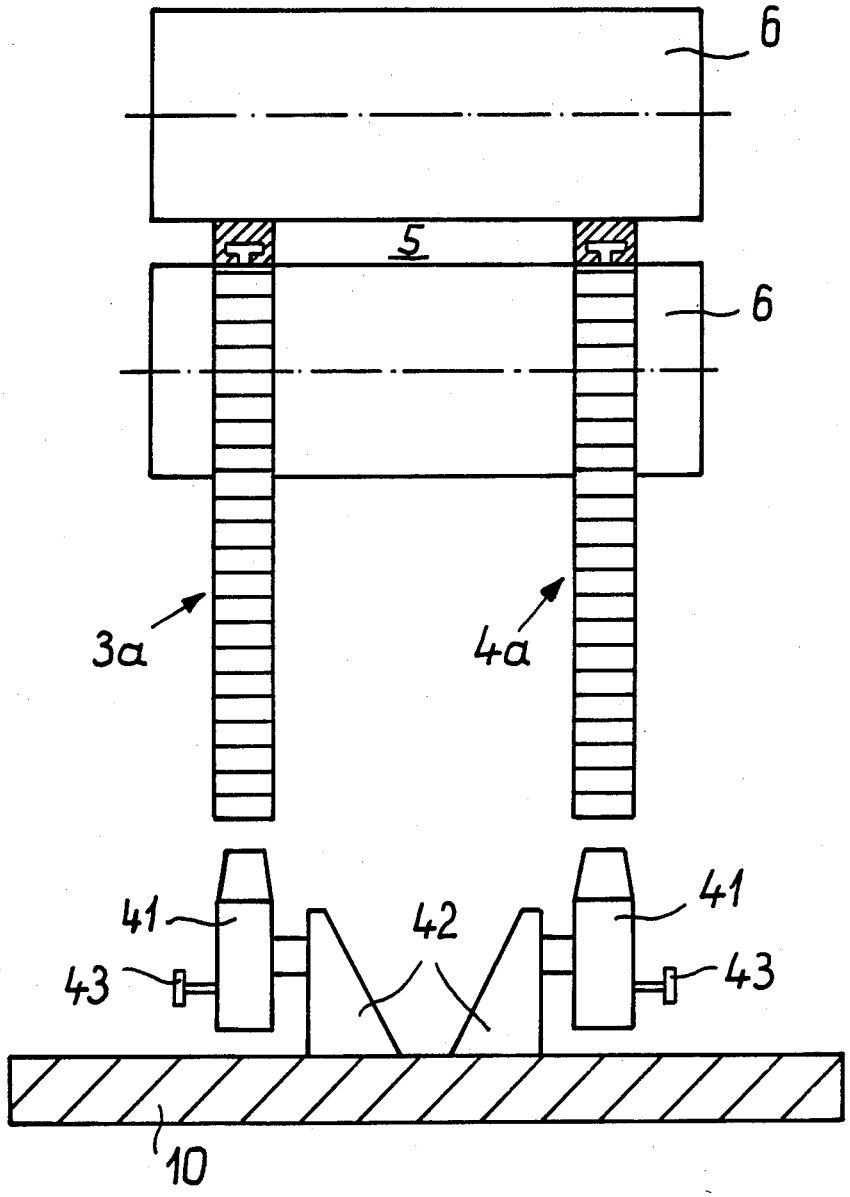
FIG. 11 is a schematic sectional front view of a twin-belt continuous caster according to FIG. 9 illustrating only the end drums at the mold chamber entrance, the lateral side dams defining the mold chamber and two gas-burners for preheating the side dams.

The means for preheating the side dams 3*a* and 4*a* to have a temperature at the mold chamber entrance 5*a*, at least approximately corresponding to the mean casting belt temperatures prevailing at this region, may consist of two gas-burners 41 (see FIG. 11).

The gas-burners—attached by holding devices 42 to the lower frame 10 of the twin-belt continuous caster—are arranged beneath the relating side dam 3*a* or 4*a* near to the mold chamber entrance 5*a* (see FIG. 9). The heating effect on the side dams can be varied by operating the control knobs 43 which change the output of the gas-burners 41 to a desired value.

It will be understood that the above description of the present invention is susceptible to various modifications, changes and adaptations, and the same are intended to be comprehended within the meaning and range of equivalents of the appended claims.

What is claimed is:

1. In a twin-belt continuous caster including a lower caster frame, an upper caster frame resting on said lower caster frame with the interposition of a spacer, end drums mounted on the lower and upper caster frames; lower and upper casting belts having opposite longitudinal edges and being trained about and supported by the end drums mounted on the lower and upper caster frames, respectively; an elongated mold chamber having inlet and outlet ends and being defined by four chamber walls co-travelling in a casting direction and formed of opposite length portions of said upper and lower casting belts and opposite length portions of endless side dams laterally bounding the mold chamber and being positioned between said lower and upper casting belts; said side dams having outer wall faces; support rollers mounted in said lower and upper caster frames and having longitudinal axes oriented perpendicularly to said casting direction; said support rollers being arranged for backing up said length portions of said lower and upper casting belts; stationary guide rails being in engagement with said outer wall faces of said side dams; and sealing means being in engagement with said length portions of said casting belts for sealing the mold chamber from surroundings; the improvement wherein the opposite longitudinal edges of said casting belts are substantially flush with respective said outer wall faces of said side dams at said length portions; further wherein said support rollers are shorter than the distance between said outer walls measured across said mold chamber; and further wherein said sealing means are situated laterally adjacent said support rollers; the improvement further comprising spring means resiliently supporting said sealing means.

2. A twin-belt continuous caster as defined in claim 1, wherein said sealing means have surface areas being in contact with a respective said casting belt; said surface areas being of a ceramic fiber.

3. A twin-belt continuous caster as defined in claim 1, wherein each said support roller comprises bearing means mounted in a respective said caster frame and being in registry with said mold chamber.

4. A twin-belt continuous caster as defined in claim 1, wherein each said caster frame has a transverse carrier arm extending perpendicularly to said casting direction across said mold chamber at a distance therefrom and further wherein said support rollers and said sealing means are mounted on said transverse carrier arm.

5. A twin-belt continuous caster as defined in claim 1, wherein said sealing means comprises (a) a carrier arm mounted on a respective said caster frame;

(b) cooling means for cooling said carrier arm; and (c) a rocker pivotally supported on said carrier arm; said spring means being in engagement with said carrier arm and said rocker for urging said rocker against a respective said casting belt.

6. A twin-belt continuous caster as defined in claim 1, further comprising means for preheating said side dams to have a temperature at said inlet end, at least approximately corresponding to mean casting belt temperatures prevailing at said inlet end.

7. A twin-belt continuous caster as defined in claim 1, wherein each said side dam has a first width measured perpendicularly to said casting direction, and said sealing means has a second width, measured perpendicularly to said casting direction, with which said sealing means is in engagement with a respective said casting belt; said first and second widths have approximately the same magnitude.

8. A twin-belt continuous caster as defined in claim 7, wherein each said support roller has an axial length less than a width of said mold chamber measured parallel to the length of said support roller.

9. A twin-belt continuous caster as defined in claim 1, wherein said sealing means are first sealing means; further comprising second sealing means positioned between said lower and upper caster frames for sealing the caster frames at a height of said mold chamber; a cooling space situated laterally of said mold chamber and bounded by said caster frames, said first and second sealing means, and respective said outer wall faces of said side dams.

10. A twin-belt continuous caster as defined in claim 9, wherein said second sealing means comprises a sealing bar extending parallel to the casting direction and being in a sealing engagement with said lower and upper caster frames.

11. A twin-belt continuous caster as defined in claim 1, wherein said mold chamber has an inlet zone, an outlet zone downstream of said inlet zone as viewed in said casting direction and a length measured parallel to said casting direction; further comprising cooling means for cooling said side dams in said outlet zone of said mold chamber.

12. A twin-belt continuous caster as defined in claim 11, further comprising additional cooling means for cooling said side dams along a length portion of said mold chamber, said length portion being situated downstream of said inlet zone and upstream of said outlet zone.

13. A twin-belt continuous caster as defined in claim 11, wherein said cooling means comprises a plurality of coolant-carrying conduits each having an outlet opening situated adjacent and oriented toward a respective said outer wall face of said side dams.

14. A twin-belt continuous caster as defined in claim 13, wherein said conduits and outlet openings are formed in said guide rails.

* * * * *